US005169299A

United States Patent [19]

Gannaway

[11] Patent Number: 5,169,299

[45] Date of Patent: Dec. 8, 1992

[54] ROTARY VANE COMPRESSOR WITH REDUCED PRESSURE ON THE INNER VANE TIPS

[75] Inventor: Edwin L. Gannaway, Adrian, Mich.

[73] Assignee: Tecumseh Products Company, Tecumseh, Mich.

[21] Appl. No.: 778,530

[22] Filed: Oct. 18, 1991

[51] Int. Cl.[5] ..... F04C 18/344; F04C 29/02

[52] U.S. Cl. ..... 418/94; 418/257; 418/269

[58] Field of Search ..... 418/91, 257, 269, 94

[56] References Cited

U.S. PATENT DOCUMENTS

| | | | |
|---|---|---|---|
| 1,023,872 | 4/1912 | Pearson . | |
| 1,436,863 | 11/1922 | Crouse | 418/257 |
| 1,666,466 | 4/1928 | Peters . | |
| 1,743,539 | 1/1930 | Gasal . | |
| 2,026,739 | 1/1936 | Johnson | 418/257 |
| 2,070,662 | 2/1937 | Johnson | 418/91 |
| 2,312,961 | 3/1943 | Cowherd . | |
| 2,330,565 | 9/1943 | Eckart . | |
| 2,562,698 | 7/1951 | Clerc | 418/269 |
| 3,464,395 | 9/1969 | Kelly . | |
| 4,260,343 | 4/1981 | Watanabe et al. | 418/269 |
| 5,033,946 | 7/1991 | Sakamaki et al. | 418/269 |

FOREIGN PATENT DOCUMENTS

| | | | |
|---|---|---|---|
| 52-46510 | 4/1977 | Japan | 418/257 |
| 839648 | 6/1960 | United Kingdom | 418/257 |

*Primary Examiner*—John J. Vrablik
*Attorney, Agent, or Firm*—Baker & Daniels

[57] ABSTRACT

In a rotary vane hermetic compressor an improved loading structure is provided for the vanes. A pressure reducing means incorporated into the compressor rotor reduces the frictional loading of the vane tips against the compressor walls. A passageway vents fluid at suction pressure into a cavity in the rotor containing the inner tips of the sliding vanes.

9 Claims, 1 Drawing Sheet

ROTARY VANE COMPRESSOR WITH REDUCED PRESSURE ON THE INNER VANE TIPS

BACKGROUND OF THE INVENTION

This invention pertains to hermetic rotary vane compressors for compressing refrigerant in refrigeration systems such as refrigerators, freezers, air conditioners and the like. In particular, this invention relates to reducing frictional loading of the vanes on the compressor walls.

In general, prior art rotary vane hermetic compressors comprise a housing in which are positioned a motor and compressor cylinder. The motor drives a crankshaft for revolving a rotor inside the cylinder. One or more sliding vanes are slidably received in slots located through the rotor walls. The vanes, cooperating with the rotor and cylinder walls, provide the pumping action for compressing refrigerant within the cylinder bore.

The operating parts of rotary hermetic compressors are machined to extremely close tolerances and the surfaces of the parts are finished to a high degree in order to prevent leakage in the compressor and to provide a very efficient compressor.

One of the problems encountered in prior art hermetic compressor arrangements has been high frictional loading between the rotary vane tips and the cylinder walls. At times, insufficient oil reaches the critical areas of the vane tips of the compressor. A reduction in the frictional loading on the vane tips would reduce wear and increase compressor efficiency.

SUMMARY OF THE INVENTION

The present invention overcomes the disadvantage of the above described prior art rotary vane hermetic compressors by providing a pressure reducing means. According to the preferred form of the present invention, a rotary compressor includes a pressure reducing means provided to the radially inner edges of the rotary vanes sliding within the rotor and against the cylinder wall, therefore reducing the frictional loading between the vanes and the cylinder wall.

The present invention according to one form thereof comprises a passageway for venting fluid at suction pressure to a region within the rotor in contact with the radially inner edges of the vanes. This venting causes a pressure differential across the sliding vanes.

One advantage of the rotary vane compressor of the present invention is that frictional loading on the radially outer vane tip against the cylinder walls is reduced. Since the radially outer vane tips experience substantial discharge pressure and the radially inner tips experience suction pressure, the net force on the vanes is away from the cylinder walls.

Another advantage according to the present invention is that the reduced frictional loading decreases the friction loss within the compressor therefore allowing more efficient operation.

Yet another advantage according to the present invention is that the friction losses at the radially outer edges of the vanes are reduced because vane loads are transferred to a bearing within the rotor where velocities are lower and full oil lubrication is attainable.

A yet further advantage according to the structure of the present invention is that a minimum amount of heat due to frictional losses is generated. Heat transfer within the compressor is minimized and the compressor efficiency is improved.

The invention, in one form thereof, provides a rotary vane compressor for use in compressing refrigerant fluid. The compressor includes a rotor disposed in a cylinder defining a compression chamber. At least one vane is slidably received within the rotor. The vane extends in a generally radial direction having radially inner and outer vane tips with the outer tips in sliding contact with the cylinder. The inner vane tips are located within a radially inner cavity defined by the rotor. The compressor includes a pressure reducing means for reducing the pressure within the rotor cavity to a pressure lower than the fluid pressure within the compression chamber whereby frictional loading of the radially outer vane tip is reduced. The pressure reducing means preferably comprises a passageway for venting fluid from a suction pressure region at suction pressure which is communicated to the compression chamber. The passageway venting fluid into the rotor inner cavity.

In one aspect of the previously described form of the invention, a bearing disposed within the rotor cavity is provided where the radially inner tip of the slidable vane presses against the bearing. The bearing comprises a bearing pin disposed within the rotor cavity which is attached to the cylinder cover and a roller disposed around the bearing pin with the radially inner tip of the vane pressing against the roller.

In a further aspect, the compressor has a drive shaft that rotates the rotor. The rotor is eccentrically located in the cylinder with the bearing pin eccentric within the rotor whereby the vanes slide within the rotor as drive shaft rotates the rotor within the cylinder.

In accord with another aspect of the invention, oil lubrication is provided at the contact between the bearing pins and bearing. Consequently, the vane load is supported in a bearing with full film lubrication thereby reducing friction and providing greater efficiency.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 2:
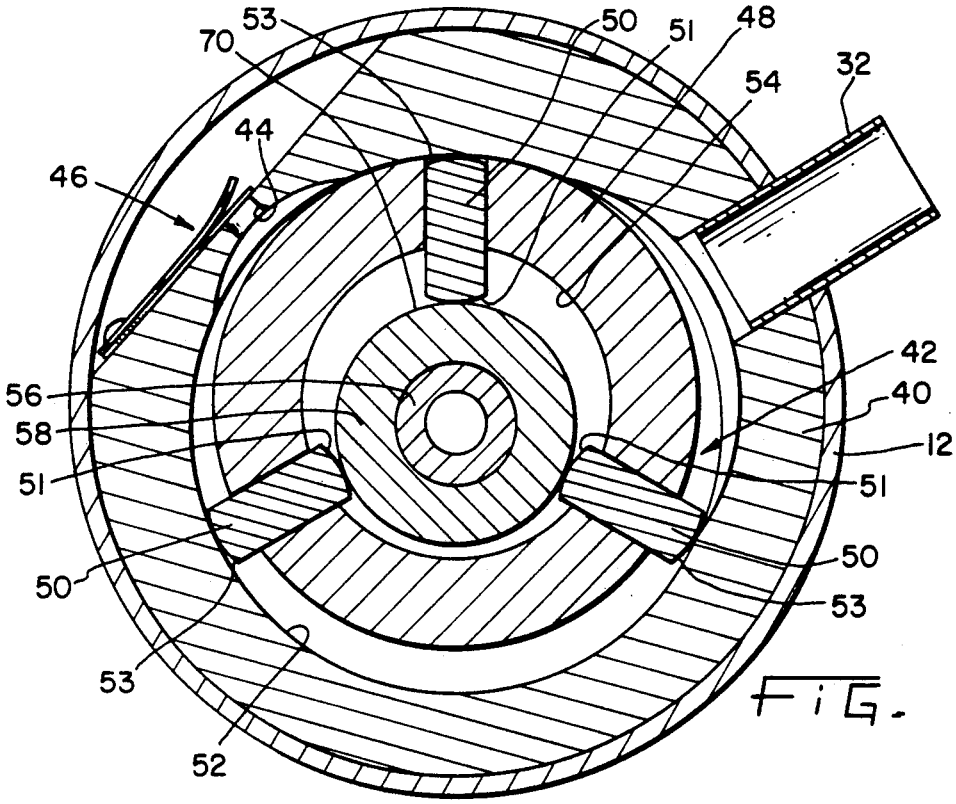
FIG. 2 is a sectional view of the compressor taken along line 2—2 of FIG. 1.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Figure 1:
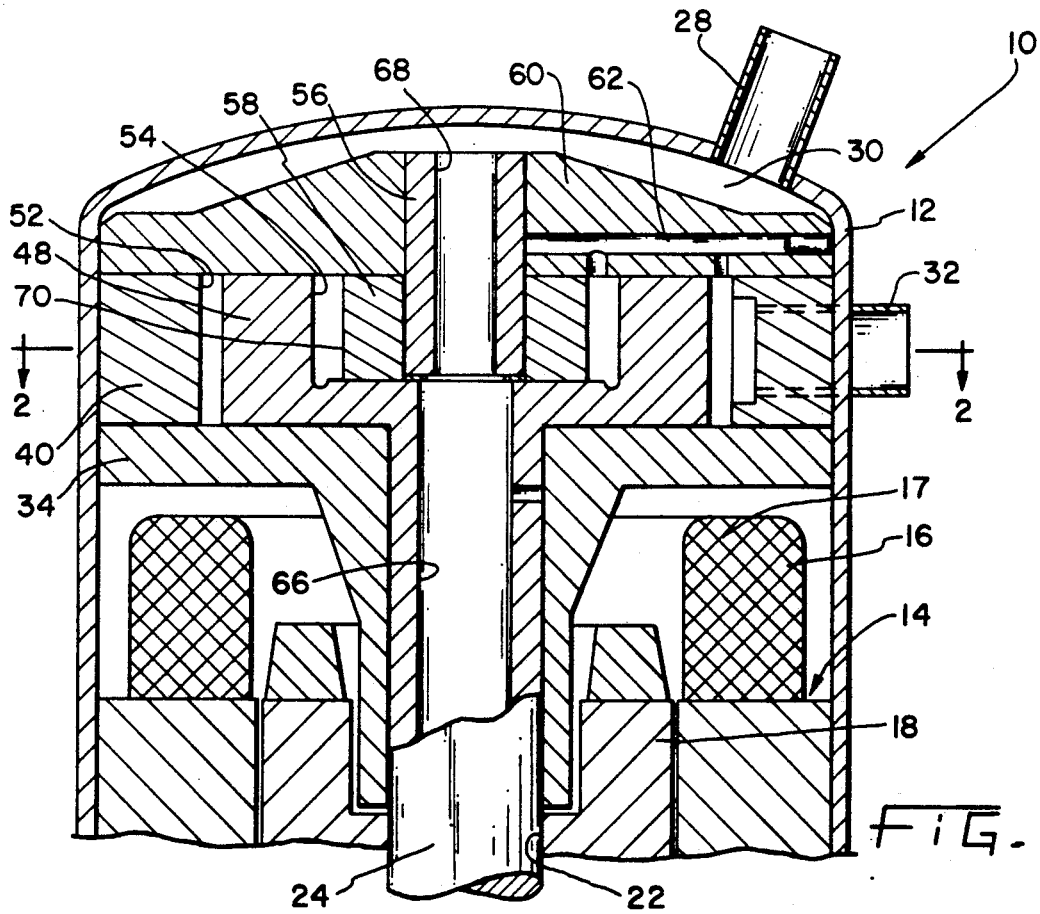
FIG. 1 is a sectional view of the compressor of the present invention.

In an exemplary embodiment of the invention as shown in the drawings and in particular by referring to FIG. 1, a compressor 10 is shown having a housing designated at 12. Located inside hermetically sealed housing 12 is a motor generally designated at 14 having a stator 16 and rotor 18. The stator 16 is provided with windings 17. The stator 16 is secured to the housing 12 by an interference fit such as by shrink fitting. The rotor 18 has a central aperture 22 provided therein into which is secured a drive shaft 24 by an interference fit. A terminal cluster (not shown) is provided on a side portion of compressor 10 for connecting motor 14 to a source of electrical power. Frame member 34 is attached to housing 12 above motor 14. Compressor cylinder block 40 is attached to both frame 34 and housing 12. A refrigerant discharge tube 28 extends through the top of housing 12 and has an end thereof extending into the interior 30 of the compressor as shown. Tube 28 is sealingly connected to housing 12 by soldering. Similarly, a suction tube 32 extends into the interior of compressor housing.

FIG. 2 shows compressor cylinder block 40 with suction tube 32 in communication with compression cavity 42. A discharge port 44 and discharge valve assembly 46 are also in communication with cavity 42.

Within compressor cylinder 40 is a rotor 48 in which is located a plurality of slidable vanes 50 having radially inner tips 51 and radially outer tips 53. Outer tips 53 are in contact with compression cylinder wall 52. Rotor 48 has an interior cavity 54 in which is disposed a bearing pin 56 having an oil passageway 68. Around bearing pin 56 is a bearing roller 58 in engagement with all slidable vanes 50. Rotor 48 is connected to drive shaft 24 thereby allowing rotational movement within cavity 42. Bearing pin 56 and roller 58 are offset from the rotational axis of rotor 48 while rotor 48 is eccentrically disposed within cavity 42. Bearing pin 56 is disposed within rotor cavity 54 and attached to cylinder cover 60. This placement allows vanes 50 to slide within rotor 48 as it rotates.

A centrifugal oil pump (not shown) of conventional design is connected to the bottom of drive shaft 24 for pumping oil from an oil sump (not shown) contained in the bottom of housing 12. Oil pump transmits oil up through axial oil passage 66 within drive shaft 24. Oil continues to flow up through bearing pin oil passage 68 and out into compressor interior 30. Oil also leaks on to the frictional surfaces between roller 58 and rotor 48. This oil coats outside diameter 70 of roller 58 reducing the friction between roller 58 and vane tips 51.

FIG. 1 shows a cylinder cover 60 covering both compression cylinder rotor 48 and bearing pin 56. A passageway 62 connects interior cavity 54 of rotor 48 with the suction pressure area adjacent suction inlet tube 32. This reduces vane 50 loading upon cylinder wall 52 thereby reducing friction.

In operation, compressor 10 operates as follows. Electric power is applied to compressor motor 14 causing drive shaft 24 to rotate thereby rotating rotor 48 within compression cavity 42. Because of the eccentric position of bearing pin 56 and bearing roller 58 in relation to the axis of rotor 48, the rotation of rotor 48 causes vanes 50 to slide within rotor 48. The rotation of sliding vanes 50 within compression cavity 42 causes fluid to be transported and compressed from suction inlet tube 32 to discharge port 44 and valve assembly 46.

During rotation, vanes 50 slidably engage cylinder walls 52 creating a frictional load between outer vane tips 64 and cylinder wall 52. The pressure relieving passageway 62 between the suction area adjacent suction inlet tube 32 and inside rotor interior cavity 54 allows fluid at suction pressure to fill rotor interior cavity 54. The bearing force of vanes 50 is the result of a pressure difference between discharge pressure in compression cavity 42 and suction pressure in rotor interior cavity 54. Frictional loading takes place against the bearing pin 56 and roller 58 instead of against cylinder wall 52. Oil is pumped up from the oil sump (not shown) and traverses through drive shaft 24, escaping through the interface between bearing pin 56 and rotor 48, thereby lubricating roller 58 and bearing pin 56. Since the point of contact and loading between vanes 50 and bearing pin 56 is at a place where the relative velocities are lower and full oil lubrication is possible, the compressor efficiency is increased with a subsequent decrease in power usage.

What has therefore been disclosed is a rotary hermetic compressor wherein gaseous refrigerant at suction pressure is induced into an inner cavity in the rotor whereby the pressure differential between the compression chambers and the inner rotor cavity reduce the frictional loading of the vanes along the compressor cylinder walls and increase the frictional loading within the rotor on a bearing roller and bearing pin. Since the vane load is transferred to the bearing pin friction forces at the cylinder walls are greatly reduced with a resultant increase in efficiency.

It will be appreciated that the foregoing description of various embodiments of the invention is presented by way of illustration only and not by way of any limitation and that various alternatives and modifications may be made to the illustrated embodiments without departing from the spirit and scope of the invention.

What is claimed is:

1. A rotary vane compressor for compressing refrigerant fluid, comprising:

a cylinder;

a rotor disposed in said cylinder defining a compression chamber, said rotor having at least one vane slidably received therein, said vane extending in a generally radial direction and having radially inner and outer vane tips, said radially outer tip in sliding contact with said cylinder, said rotor defining a radially inner cavity in which said radially inner tip of said vane is located;

a suction pressure region where fluid at suction pressure is communicated to said compression chamber;

rotation of said rotor and vane compressing the fluid in said compression chamber to a higher pressure than said suction pressure; and pressure reducing means for reducing the pressure within said rotor inner cavity to a pressure lower than said higher fluid pressure within said compression chamber, said pressure reducing means includes a bearing disposed within said rotor cavity, said radial inner tip of said vane pressing against said bearing whereby frictional loading on said radially outer vane tip is reduced.

2. The rotary vane compressor of claim 1 in which said pressure reducing means comprises a passageway for venting fluid from said suction pressure region into said rotor inner cavity.

3. The rotary vane compressor of claim 1 in which said bearing comprises:

a bearing pin disposed within said rotor cavity and attached to said cylinder; and a roller disposed around said bearing pin in said rotor cavity, said radial inner tip of said vane pressing against said roller.

4. The rotary vane compressor of claim 1 having a drive shaft that rotates said rotor, said rotor eccentrically located in said cylinder and said bearing pin eccentric to said rotor whereby said vane slides within said rotor as drive shaft rotates said rotor.

5. The rotary vane compressor of claim 1 having a plurality of vanes.

6. The rotary vane compressor of claim 1 in which said pressure reducing means comprises a passage for venting fluid from said rotor inner cavity whereby said fluid pressure within said rotor inner cavity is lower than fluid pressure within said compression chamber.

7. A rotary vane compressor for compressing refrigerant fluid at suction pressure to discharge pressure, comprising:

a cylinder;

a rotor disposed in said cylinder defining a compression chamber, said rotor having at least one vane slidably received therein, said vane extending in a generally radial direction having a radially inner and outer tip, said outer tip in sliding contact with said cylinder, said rotor defining a radially inner cavity in which said radially inner tip of said vane is located;

a bearing disposed in said rotor cavity and attached to said cylinder;

a roller disposed around and in contact with said bearing, said roller in bearing contact with said vane; and passage means for fluid at suction pressure to communicate with said rotor inner cavity, whereby frictional forces at the contact between said vane and said cylinder is reduced.

8. The rotary vane compressor of claim 7 further comprising a means for pumping oil into said cavity.

9. The rotary vane compressor of claim 7 having a plurality of vanes.

* * * * *